US006045053A

United States Patent [19]

Ruud

[11] Patent Number: 6,045,053

[45] Date of Patent: Apr. 4, 2000

[54] TRIBO-ELECTRIC POWDER SPRAY COATING USING CONICAL SPRAY

[75] Inventor: Jan Ruud, Hjälteby, Sweden

[73] Assignee: Nordson Corporation, Westlake, Ohio

[21] Appl. No.: 09/165,650

[22] Filed: Oct. 2, 1998

Related U.S. Application Data

[63] Continuation of application No. PCT/SE96/00445, Apr. 4, 1996.

[51] Int. Cl.[7] ..... B05B 5/00

[52] U.S. Cl. ..... 239/3; 239/700; 239/704; 239/708; 239/436; 239/696

[58] Field of Search ..... 239/1, 3, 436, 239/456, 690, 690.1, 694, 695, 696, 697, 698, 704, 708, 700; 427/476, 475, 483, 484, 181

[56] References Cited

U.S. PATENT DOCUMENTS

| | | | |
|---|---|---|---|
| 2,185,886 | 1/1940 | Caldwell | 239/456 X |
| 3,521,815 | 7/1970 | Szasz . | |
| 3,667,674 | 6/1972 | Parsons et al. . | |
| 3,767,116 | 10/1973 | Clausen et al. . | |
| 3,873,024 | 3/1975 | Probst et al. . | |
| 3,924,810 | 12/1975 | Otterstetter . | |
| 4,248,379 | 2/1981 | Hollstein et al. . | |
| 4,788,933 | 12/1988 | Buschor | 239/698 X |
| 4,815,666 | 3/1989 | Gacka et al. | 239/456 X |
| 5,344,082 | 9/1994 | Haller et al. | 239/690 X |
| 5,400,976 | 3/1995 | Kaijyu et al. | 239/708 X |

FOREIGN PATENT DOCUMENTS

| | | |
|---|---|---|
| 2-583-310 | 6/1985 | France . |
| 29-30-121 | 2/1981 | Germany . |
| 55-39262 | 3/1980 | Japan . |
| 1270452 | 4/1972 | United Kingdom . |
| 95/08397 | 3/1995 | WIPO . |
| 97/37769 | 10/1997 | WIPO . |

*Primary Examiner*—Andres Kashnikow
*Assistant Examiner*—Robin O. Evans
*Attorney, Agent, or Firm*—Calfee, Halter & Griswold LLP

[57] ABSTRACT

Apparatus for powder spray coating comprises means for electrostatically-charging powder entrained in air, a conduit for transporting the electrostatically charged powder from the charging means to a spray head adapted to discharge the powder in a hollow conical spray pattern, wherein the spray head comprises means for diverting at least a portion of the flow of charged powder towards a spray device mounted to the spray head and adapted to discharge powder in a substantially uniform conical spray pattern, the spray head, spray device and the hollow conical and conical spray patterns being substantially symmetrical about a common longitudinal axis. The apparatus is particularly suitable for coating a large surface area. Preferably multiple tribo-electric charging means are used and a pump is used to supply powder to the multiple charging means through a common distributor. After passing through the multiple charging means the powder flows are then recombined and sprayed through a common spray apparatus. The apparatus may include multiple powder sources and means to change rapidly the powder being sprayed from one powder source to another.

49 Claims, 10 Drawing Sheets

FIG.10
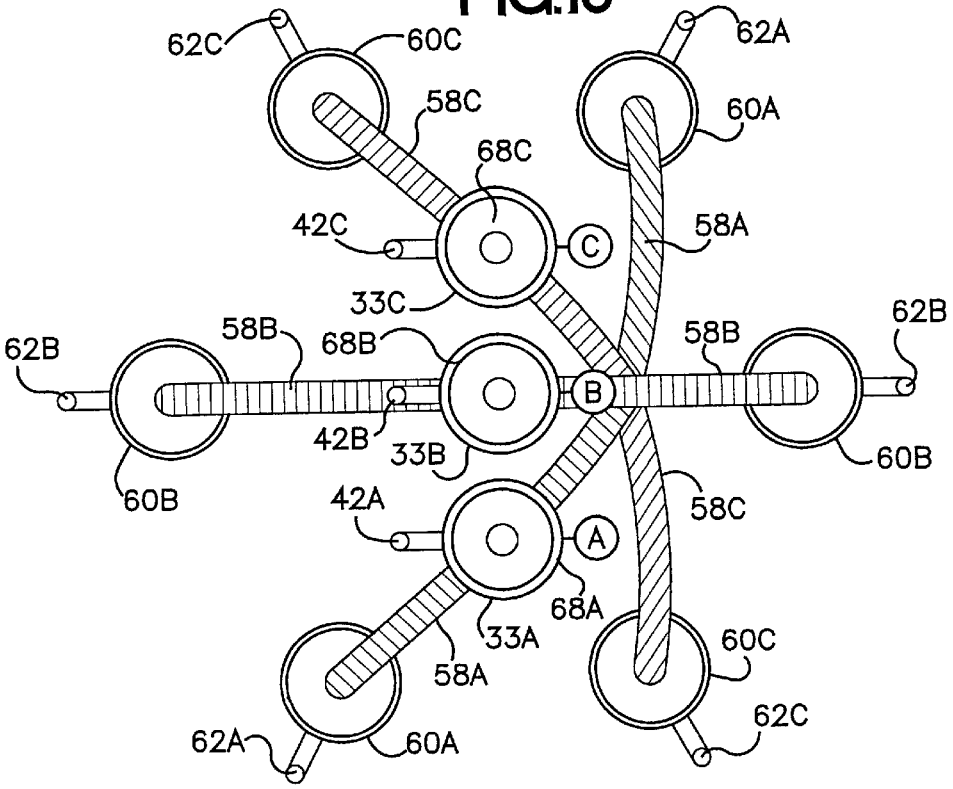
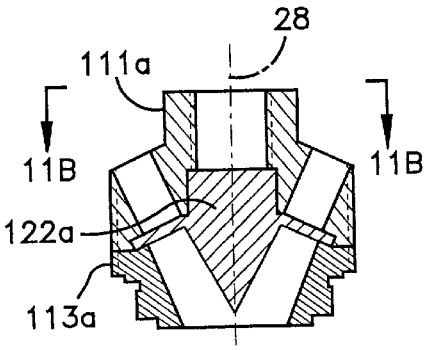
FIG.11A
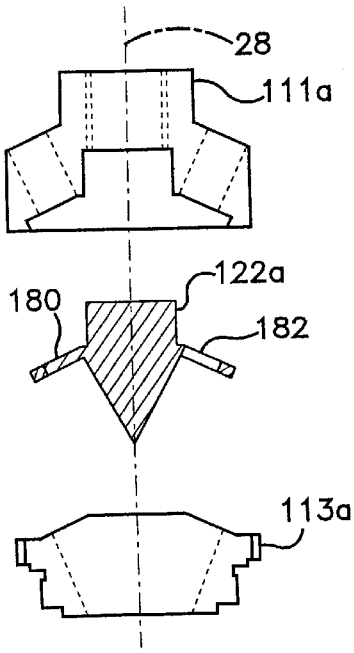
FIG.11C
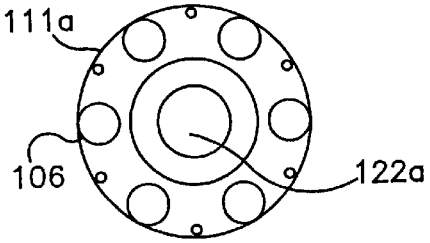
FIG.11B

TRIBO-ELECTRIC POWDER SPRAY COATING USING CONICAL SPRAY

This application is a continuation of copending International Application No. PCT/SE96/00445 filed on Apr. 4, 1996 and which designated the U.S.

FIELD OF THE INVENTION

This invention relates to apparatus and methods for powder spray coating a large surface area, such as the surface of a large panel, or of a plurality of small objects.

BACKGROUND OF THE INVENTION

In conventional powder coating methods and apparatus, a pressurized electrostatically charged mixture of gas and powder particles is sprayed outwardly from a gun in the direction of an object to be coated. The charged powder particles in the mixture repel one another as they travel toward the object to be coated, and the lower electrical potential of the object to be coated electrostatically attracts the particles.

When powder coating an object having a large surface area using a single spray device the spray device or the object must be moved so as to coat the whole area, and this takes a considerable time and reduces the maximum throughput of a powder coating system.

Conventional electrostatic powder coating methods and apparatus present further problems when coating a large surface area. When using an external electrode to establish an electrostatic field between the spray device, or gun, and the object, the strongest lines of electrostatic force are located along the direct line between the electrode and the nearest point on the object (the 'Faraday cage' effect), and electrostatic lines of force directed towards the more distant portions of the surface to be coated will be significantly weaker, with the result that the object is coated unevenly, with a varying depth of powder since the charged powder follows the electrostatic field lines to the object being coated. Additionally, particles having a higher electrostatic charge retain their charge after deposition, thereby repulsing subsequent particles and resulting in uneven coating.

These problems are addressed to an extent in International Patent Application No. PCT/GB94/01991 (publication No. WO 95/08397), which discloses a powder spray coating apparatus effective to produce substantially flat, thin spray pattern in the form of a spray disc. The apparatus is reciprocated, thereby reciprocating the spray pattern, so as to provide a uniform powder coating over a large surface area. The apparatus comprises means for electrostatically charging the powder particles before they are discharged from the spray device; there is therefore no requirement for external charging electrodes, and thus this cause of non uniformity of coating is substantially eliminated.

Apparatus of the type disclosed in PCT/GB94/01991 is particularly suitable for coating objects such as the interior of an open-ended drum. However, whatever the object to be coated, it is necessary to provide relative motion between the object and the spray device in order to coat a large surface area, because the apparatus of PCT/GB94/01991 produces a thin flat spray pattern, in the shape of a disc.

SUMMARY OF THE INVENTION

In accordance with a first aspect of this invention, powder spray coating apparatus comprises means for electrostatically charging powder entrained in air and means for transporting the flow of electrostatically charged powder from the charging means to a spray head, wherein the spray head comprises means for diverting at least a portion of the flow of charged powder towards a spray device mounted to the spray head and adapted to discharge powder in a conical spray pattern, and wherein the spray head is adapted to discharge the remaining powder in a hollow conical spray pattern, the spray head, spray device and the hollow conical and conical spray patterns being substantially symmetrical about a common longitudinal axis.

The spray head may comprise an internal chamber to which the charged powder is supplied having at least one passage from the internal chamber to at least one nozzle from which the powder is discharged and a primary deflector mounted externally of the spray head and adjacent to each nozzle to deflect the discharged powder into the hollow conical spray pattern, each nozzle being directed outwardly from the longitudinal axis, the internal chamber containing an internal deflector to deflect the flow of air-entrained electrostatically charged powder outwardly toward the or each nozzle.

Preferably the diverting means comprises one or more holes in the surface of the internal deflector rough which is diverted said portion of the flow of charged powder to channel means for conducting the diverted powder to the spray device.

The channel means may comprise a conduit for transporting the diverted powder from the holes in the internal deflector to an internal chamber in the spray device, the spray device comprising at least one passage from, the internal chamber to at least one nozzle from which the powder is discharged and a secondary deflector mounted externally of the spray device and adjacent to the each said nozzle to deflect and direct the flow of discharged powder into a conical spray pattern.

Means may be provided for moving the spray head and the deflector so as to powder coat an object having a surface area larger than that of the combined hollow conical and conical spray patterns. Alternatively, the object(s) to be coated may be moved, relative to the spray body. By providing relative movement along the longitudinal axis between the spray head and the object(s) be coated, the thickness of the powder coating may be varied.

In another aspect of the present invention, the apparatus may comprise a collar around the spray head and having a leading edge forming an annular discharge channel adjacent the nozzle(s) and the primary deflector and mounted so as to be movable along the longitudinal axis in order to adjust the size of the annular discharge channel, thereby to control the flow of powder in the hollow conical spray pattern.

In accordance with another aspect of this invention, the powder spray coating apparatus comprises means for supplying a flow of electrostatically charged powder entrained in air to an internal chamber, wherein the internal chamber contains an annular flow restrictor to control the flow of charged powder within the chamber.

The flow restrictor may be configured substantially symmetrically about the longitudinal axis, so as to ensure that, where the flow of air-entrained charged powder enters the chamber in a number of streams, the streams impinge and mix thoroughly, before the flow is deflected by the internal deflector, to homogenize the later discharge of powder from the gun in an evenly distributed spray pattern. Alternatively, the flow restrictor may be configured eccentrically about and/or along the longitudinal axis so as to distribute powder unevenly in the spray pattern.

Thorough mixing of a number of streams of air-entrained powder may be achieved by directing the streams along a tapering inlet passage in the spray head, so that the streams impinge and mix. A conical or frusto-conical guide may be provided in the tapering inlet passage so as to form a converging annular passage along which the streams are directed.

A number of devices may be used electrostatically to charge the powder particles upstream of the spray head, thereby permitting several charging devices, which individually are not capable of electrostatically charging the large volume of powder required to coat a large surface area, but which can be used in parallel for the discharge of a large volume of powder through a single spray device. Furthermore the electrostatic charging of the powder particles upstream of the spray head obviates the requirement for external electrodes, thereby improving the uniformity of the coating applied.

Where a number of electrostatic charging devices are employed, an inlet distributor may be used so that it is not necessary to have a dedicated pump to supply each charging device with powder. The inlet distributor is supplied with air-entrained powder by a single pump and acts to deflect the flow into a number of separate streams, corresponding to the number of charging devices. The inlet distributor preferably comprises features similar to those for deflecting the flow of air-entrained powder within the spray head of the apparatus in accordance with the invention. Means may be provided to introduce a flow of air into the inlet distributor so as to accelerate the flow of air-entrained powder and to assist in the thorough mixing of the powder by breaking up agglomerates and removing any powder which may accumulate on the inner surfaces of the inlet distributor.

Such an inlet distributor has the advantage that the cost of the apparatus is significantly reduced since only a single pump and a single flow control means is required rather than a pump and associated flow control means for each charging device.

Means may be provided to spray powders of different colours, with means being provided to enable rapid, automatic colour changing.

The spray head and/or the spray device nozzles may be in the form of a series of holes or slots disposed about the circumference of a circle centered on the longitudinal axis and may be so configured as to discharge the powder radially outwardly at an angle thereto towards the respective deflector, or there may be a single nozzle in the general form of an annulus, similarly configured so as to direct the powder outwardly.

The electrostatic charging means preferably comprises one or more frictional charging devices of the type such as those disclosed in British Patent Application Nos. 2066703 or U.S. Pat. No. 5,344,082 in which the powder particles become electrostatically charged by multiple frictional contacts with a tortuously configured polytetrafluoroethylene conduit. The outlets of one or more of these charging devices may be connected to supply a large volume of charged powder to the internal chamber of the spray head so as to coat a large surface area with a single spraying device.

A method of powder coating a large surface area in accordance with the invention comprises supplying air-entrained electrostatically charged powder to a spray head, diverting at least a portion of the powder to a spray device mounted to the spray head and adapted to discharge powder in a conical spray pattern, discharging the remaining portion of the powder from the spray head out of at least one nozzle and deflecting said discharge powder into a hollow conical spray pattern, the hollow conical spray pattern and the conical spray pattern being substantially symmetrical about the longitudinal axis of the spray head.

The methods and apparatus of this invention are particularly suitable for rapidly applying a powder coating of uniform thickness to a large surface area. Electrostatically charging the powder before it is discharged from the spray device reduces the Faraday cage effect and removes the electrostatic effects described above which produce a non-uniform coating.

DETAILED DESCRIPTION OF THE FIGURES

The various aspects of the invention will now be described by way of example and with reference to the accompanying drawings, in which.

Figure 4:
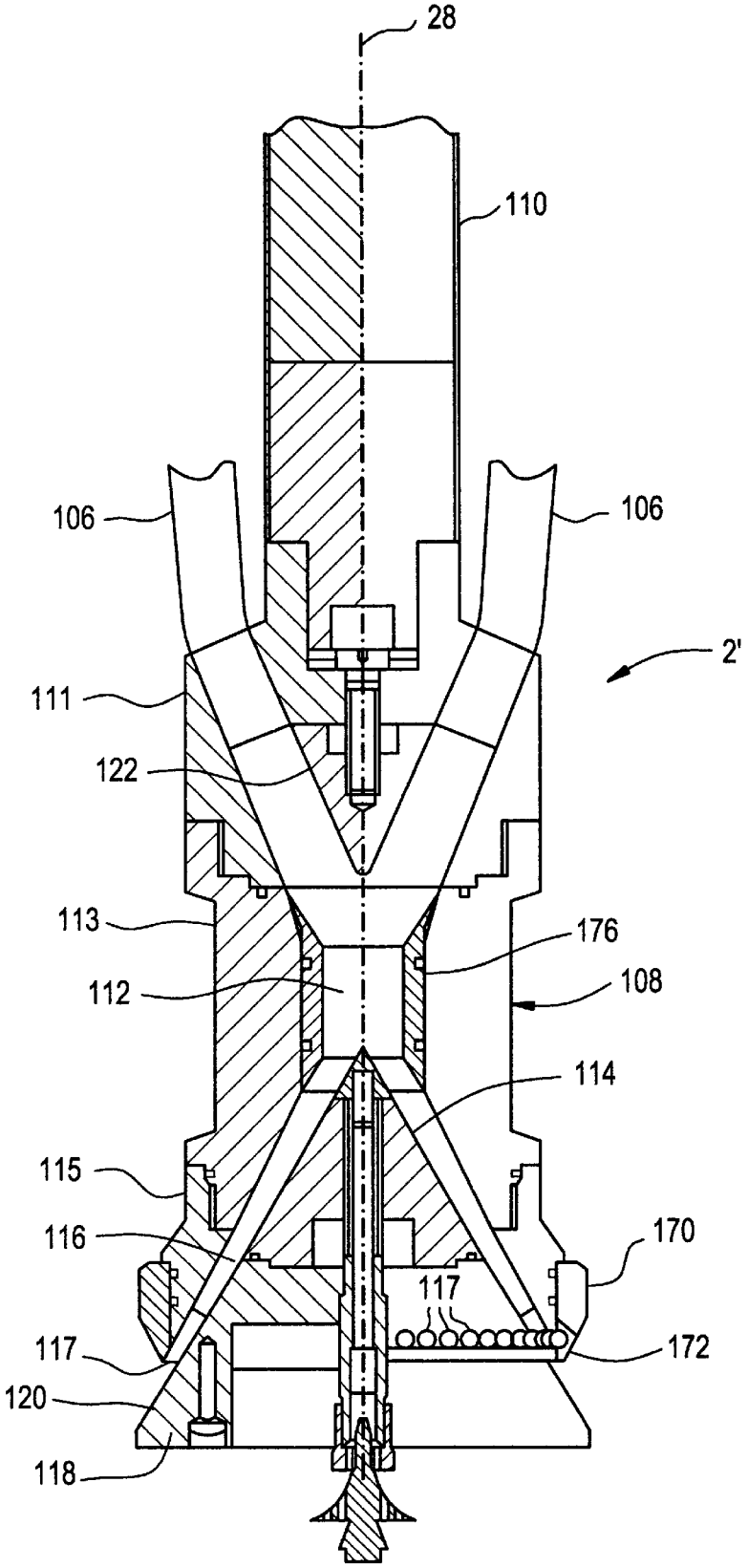
FIG. 4 is a view, in partial cross-section, of a powder spray head in accordance with the invention.
Figure 4A:
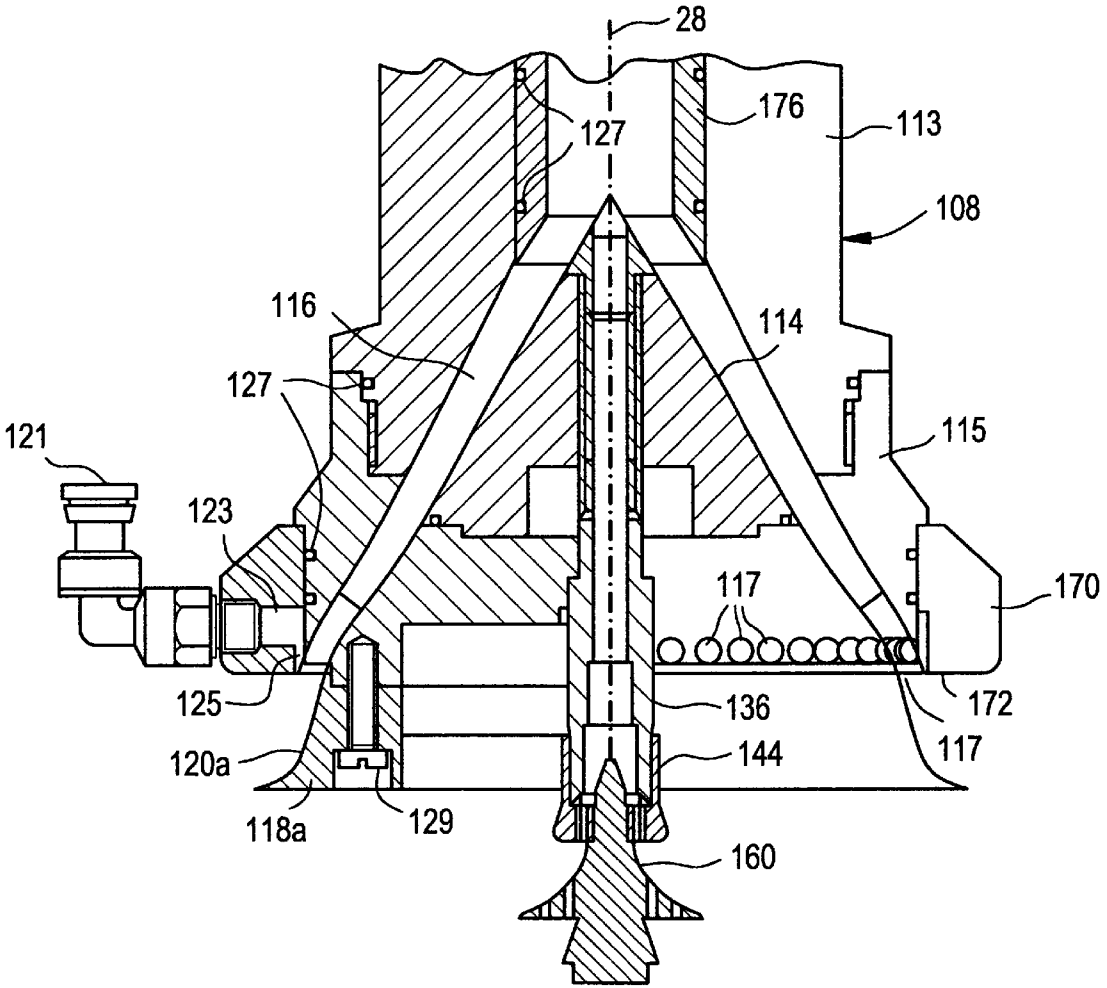
Figure 5B:
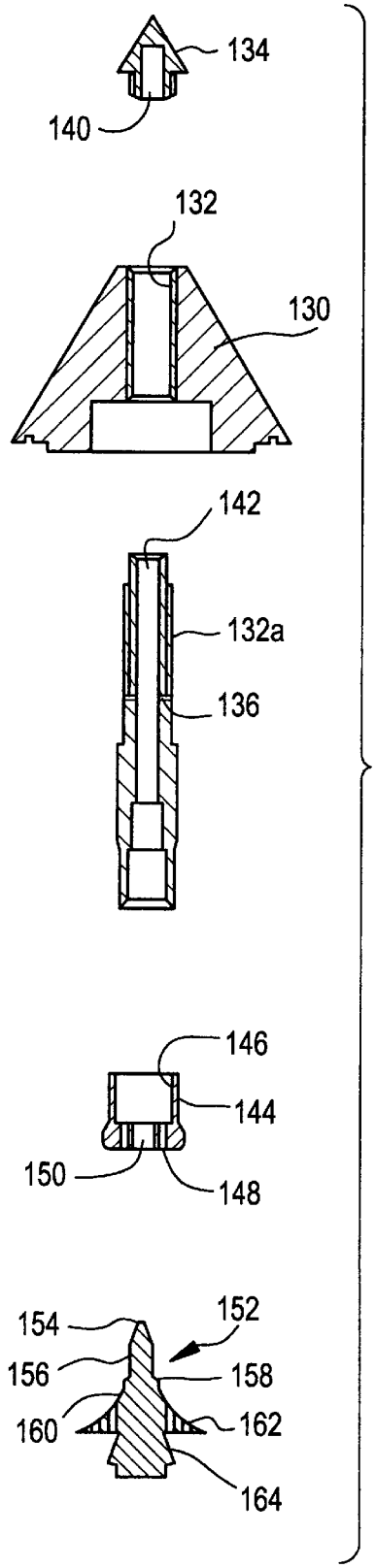
Figure 5A:
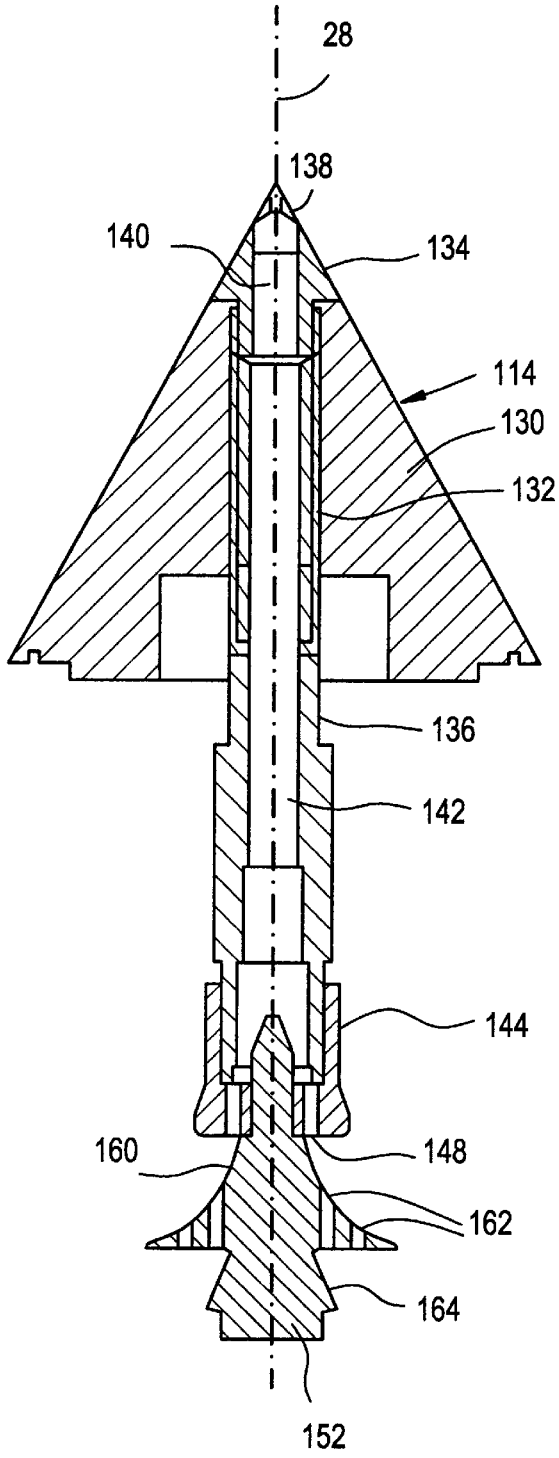
Figure 6:
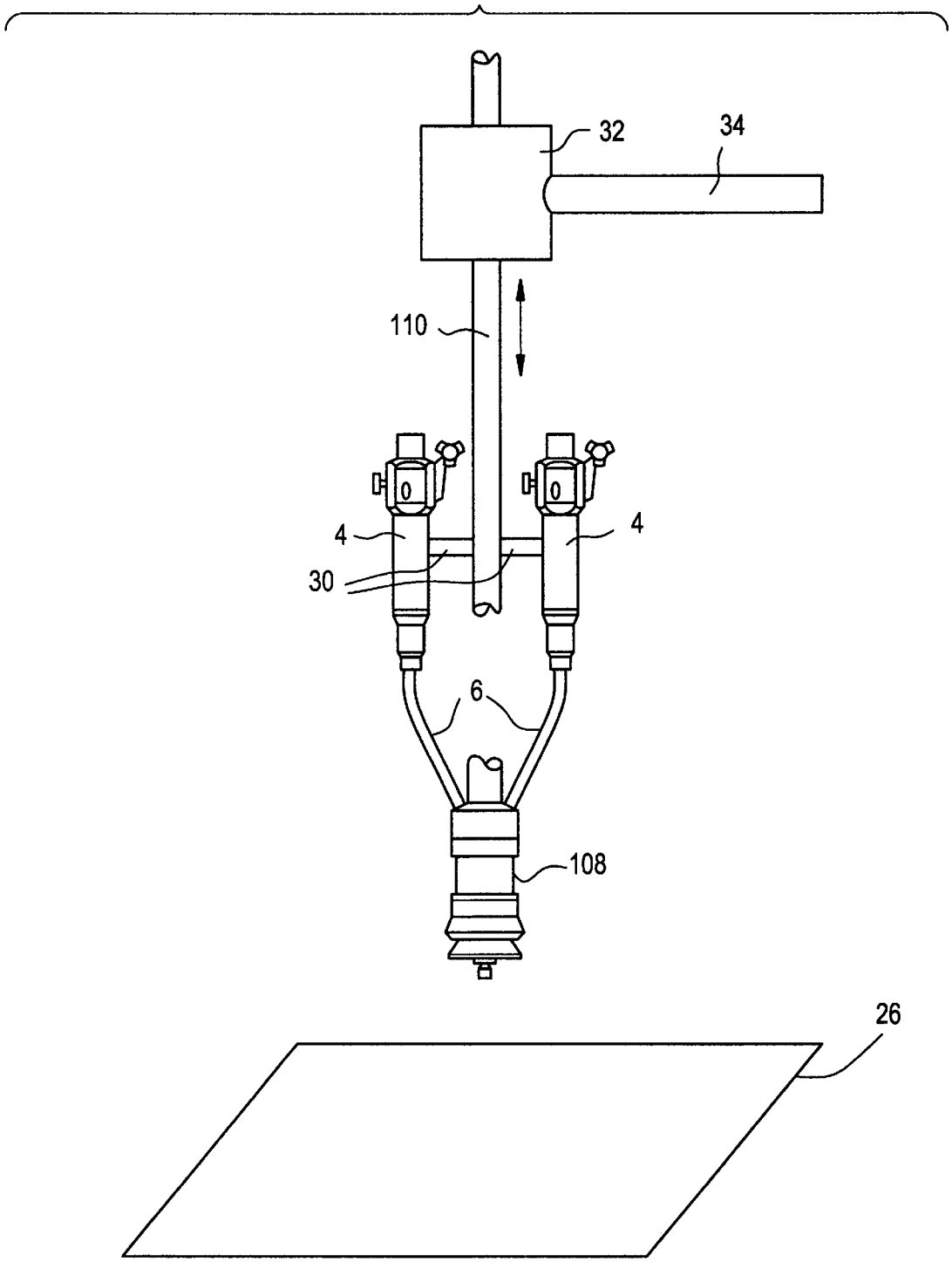
Figure 7A:
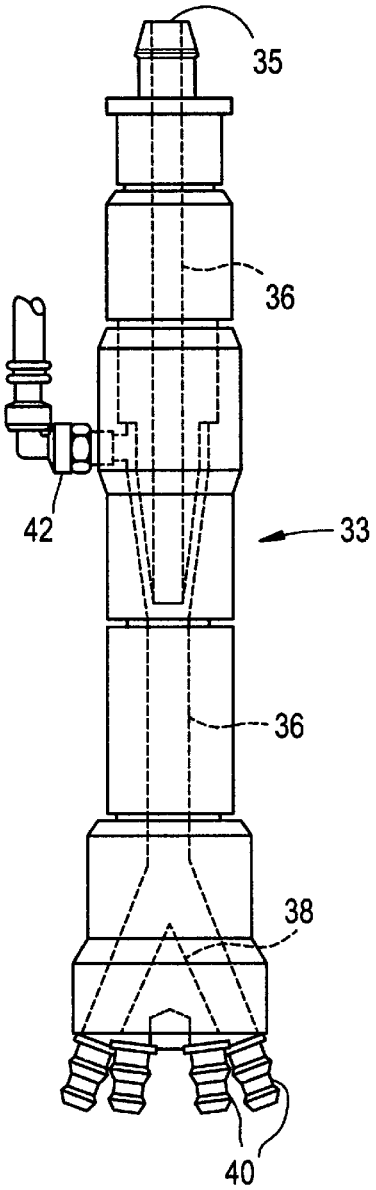
Figure 7B:
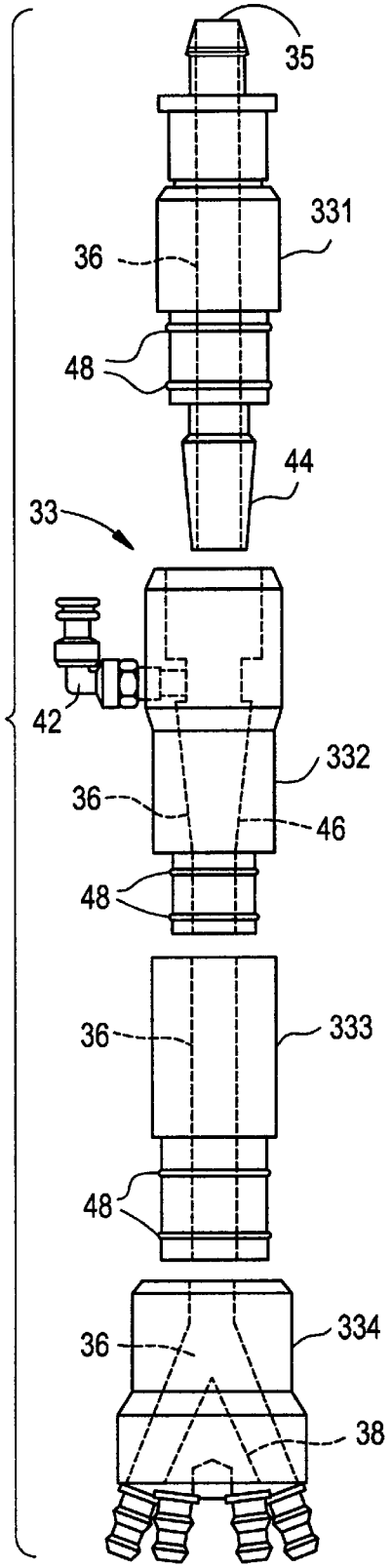
Figure 8:
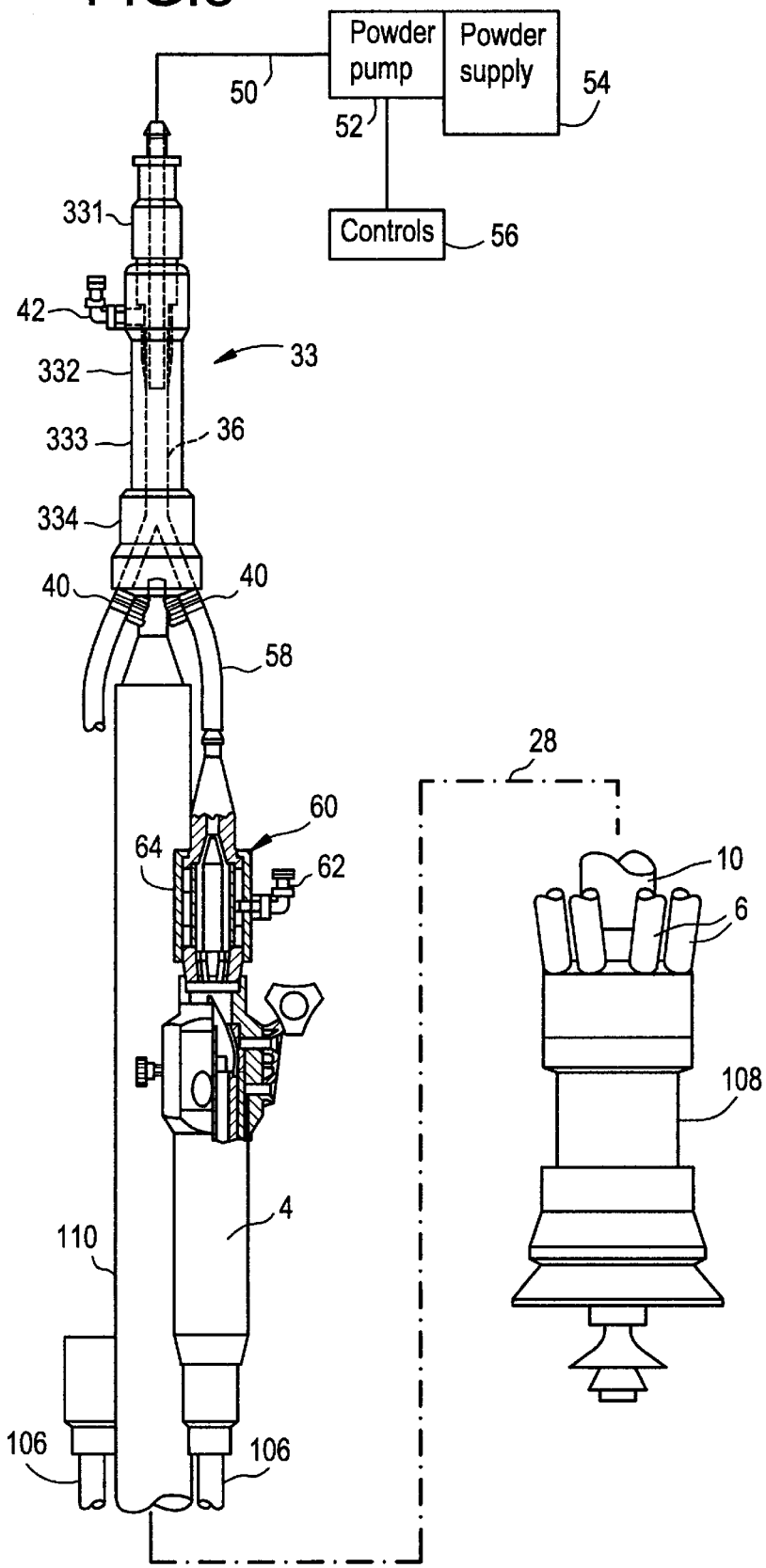

FIG. 4*a* is an enlarged view of a portion of the spray head of FIG. 4, and incorporating an alternative primary deflector and illustrating air inlet means for controlling the flow of powder deflected thereby;

FIGS. 5*a* and 5*b* are, respectively, an enlarged view of a portion of the apparatus shown in FIG. 4, and an exploded view of that portion;

FIG. 6 is a schematic drawing, showing the apparatus of FIG. 4 mounted to a reciprocating arm for coating a large flat surface;

FIGS. 7*a* and 7*b* are, respectively, an elevation view and an exploded view of an inlet distributor for directing a single flow of air entrained powder into a number of electrostatic charging devices;

FIG. 8 is a view of apparatus in accordance with the invention incorporating the inlet distributor of FIGS. 7*a* and 7*b;*

Figure 9:
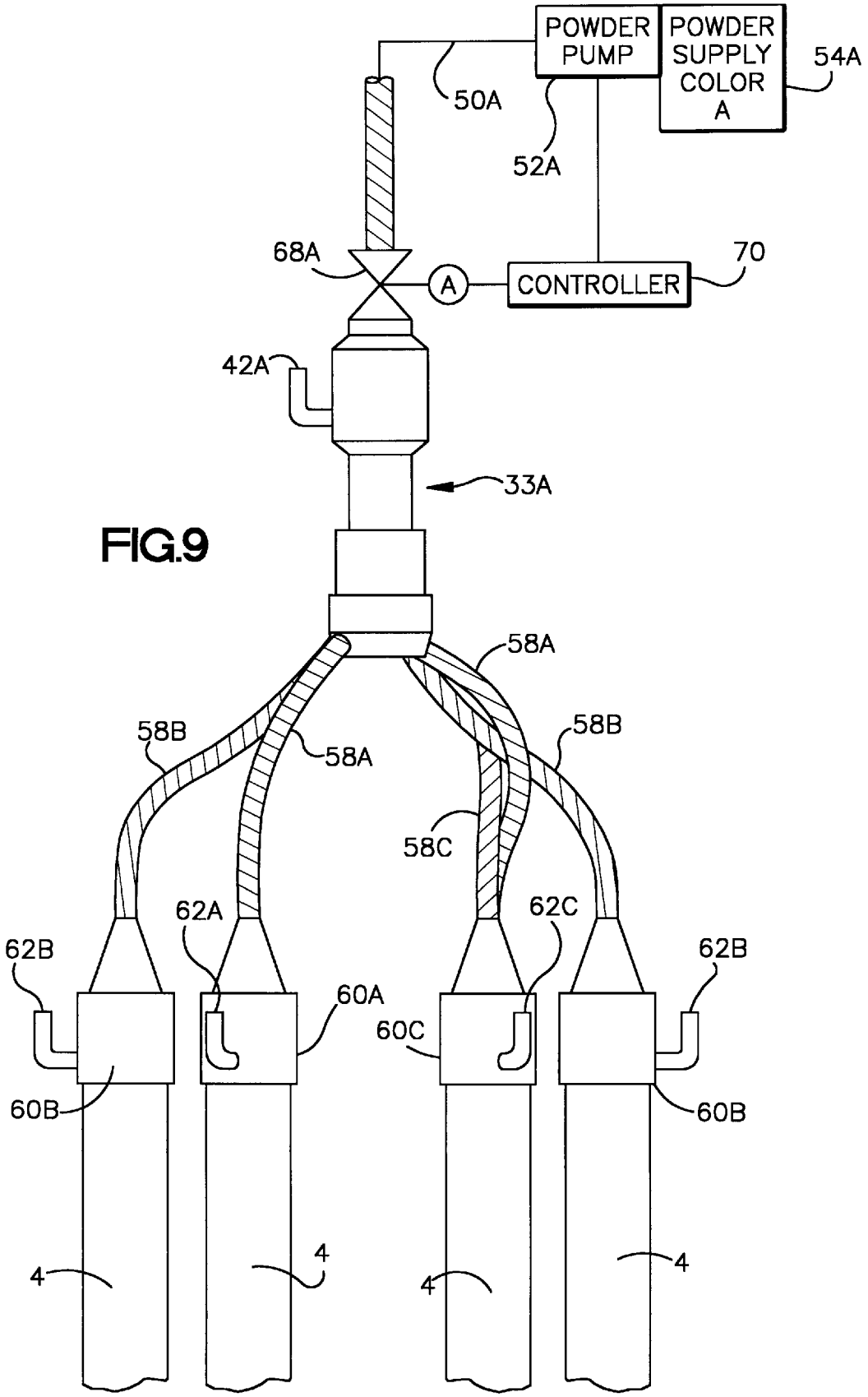

FIG. 9 is an elevation view of the powder supply portion of the apparatus shown in FIG. 8 and incorporating multiple powder sources and powder distributors;

FIG. 10 is a schematic plan view of the apparatus of FIG. 9 showing the disposition of the powder sources of different colours and distributors; and FIG. 11 shows, in cross-section and plan views an alternative form of a conical guide for the spray head of FIG. 4 incorporating a rotatable obstructing device, or obturator, for use with the colour change system of FIGS. 9 and 10 (the conical guide and adjacent portions of the spray head also being shown in an exploded view).

DETAILED DESCRIPTION OF THE INVENTION

Figure 1:
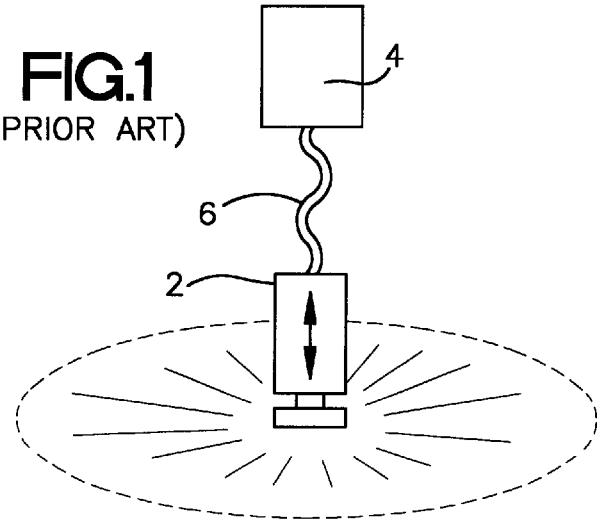
FIG.1 (PRIOR ART)
FIG. 1 is a schematic diagram of the powder coating apparatus disclosed in International Patent Application No. PCT/GB94/01991.
Figure 3:
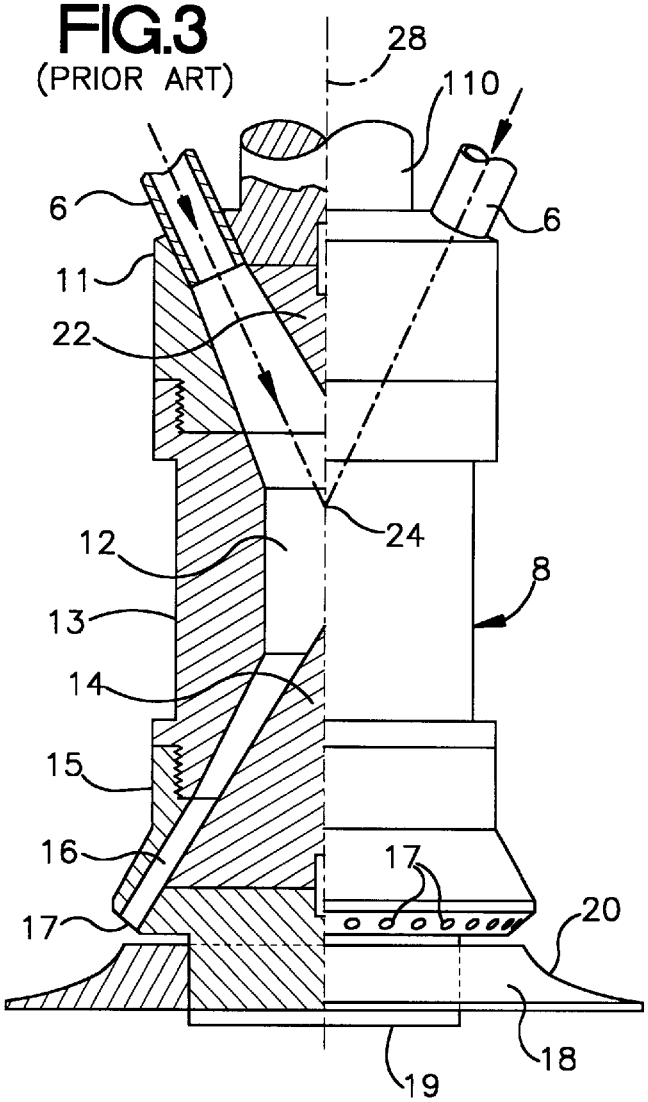
FIG.3 (PRIOR ART)
FIG. 3 is a view, in partial cross section, of an alternative form of powder spray head to that shown in FIG. 2 and as also disclosed in PCT/GB94/01991.
Figure 2:
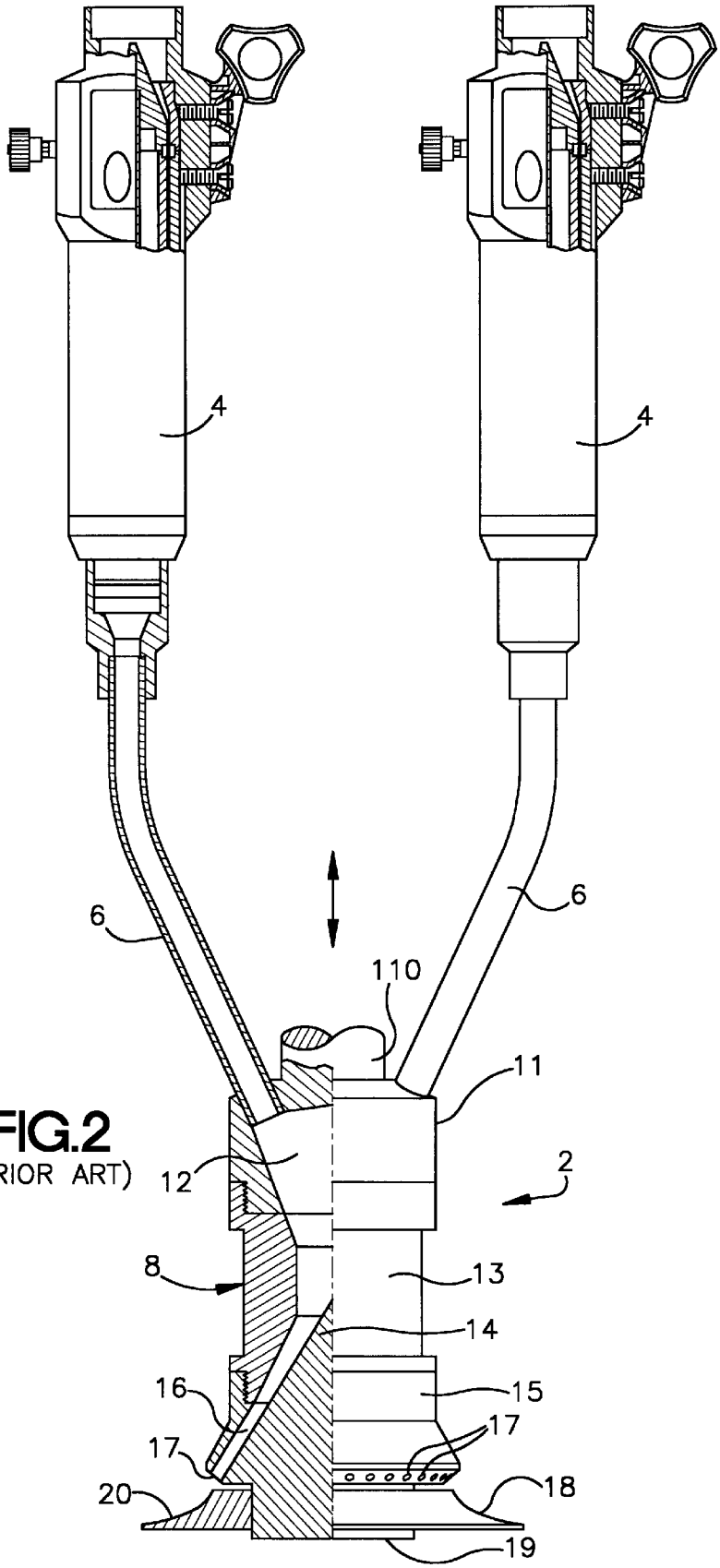
FIG.2 (PRIOR ART)
FIG. 2 is a view in partial cross-section of the apparatus of FIG. 1.

The powder coating apparatus of PCT/GB94/01991 shown in FIGS. 1 to 3 comprises, as shown in FIG. 1, a spray device 2 which is adapted to produce a thin circular spray pattern and which is provided with means (not shown) to reciprocate along an axis 28 perpendicular to the plane of the spray pattern as shown by the arrows. The spray device 2 is supplied with electrostatically charged powder entrained in air from charging apparatus indicated generally at 4. The charging apparatus 4 may be mounted remotely from the spray device and connected thereto by flexible hose 6, or it may be mounted adjacent to the spray device 2 (not shown) so that it can be reciprocated therewith.

Turning now to FIG. 2, the spray device 2 comprises a spray head 8 which is mounted to support shaft 110 by which the device 2 may be moved. Electrostatically charged air-entrained powder particles are supplied from two charging devices 4 via conduits 6 to an inlet collar 11 disposed at the end of support shaft 110. Inlet collar 11 includes the upper portion of a mixing chamber 12. The lower portion of mixing chamber 12 is contained in mixing chamber housing 13 which is secured to inlet collar 11. From chamber 12 the flow of charged powder particles is deflected outwardly by a conical deflector 14 which forms a part of distributor 15 which is secured to mixing chamber housing 13. Distributor 15 includes a plurality of circular spray nozzles 17 which communicate with the mixing chamber 12. Charged air-entrained powder particles are discharged from the nozzles 17 towards a disc deflector 18 frictionally mounted on stub 19 of distributor 15. Deflector 18 has a radiussed annular surface 20 to deflect the powder particles radially outwardly to form a substantially flat thin spray pattern in the form of a 360 degree circle lying in a plane transverse to the longitudinal axis 28 of the device 2. The deflector 18 is adjustably mounted so as to be axially movable with respect to the spray head 8 in order to set the angle of the flat spray pattern, preferably at about 90 degrees to the longitudinal axis 28 of the device 2, taking into account the velocity at which the powder is discharged from the nozzles 17 and the size and/or density of the powder particles, or to adjust the thickness of the spray pattern, or to accommodate changes in the type of powder and/or the pressure of the entraining air. The disc deflector 18 may also be replaced with another having an annular surface 20 of a greater or lesser radius to produce different angles of deflection. The angle of deflection of the flat spray pattern may also be angularly adjusted through a small angle by moving the deflector disc 18 axially relative to the spray head 8.

FIG. 3 illustrates an alternative form of prior art powder spray head 8, wherein like numerals refer to the same features as shown in the spray head of FIG. 2. A conical guide 22 is secured to inlet collar 11 to project into the internal chamber 12 to guide the separate flows of air-entrained, electrostatically charged powder (indicated by arrows) from each of the conduits 6 (only two are shown) so that they impinge and mix thoroughly at a point 24 within the chamber 12 before the flow of powder is deflected by deflector 14. The conical guide 22 also prevents powder from accumulating on those surfaces of the chamber 12 which are not in the flow path of the air-entrained powder, which accumulated powder could break off in lumps and lead to one or more of the nozzles 17 becoming blocked, or to a non-uniform coating being applied to an object. Any powder which adheres to the surface of the chamber 12 as shown in FIG. 3 is cleared by the air-entrained powder flowing thereover.

Mixing the separate powder flows thoroughly in this way ensures that the powder discharged from the nozzles 16 is homogeneously electrostatically charged and evenly distributed in the spray pattern, and adjusts for any discrepancies in powder flow rate and/or electrostatic charging produced by the separate charging device.

FIG. 4 shows a spray coating device 2' comprising a spray head 108 for coating large surface areas disposed perpendicularly to the longitudinal axis of the device and incorporating several features in accordance with the present invention. Spray head 108 is mounted to support shaft 110 and electrostatically charged air-entrained powder is supplied, from charging devices 4 (not shown), via conduits 106, to an inlet collar 111 mounted to the end of support shaft 110. Inlet collar 111 includes the upper portion of a mixing chamber 112 and contains a conical guide 122, which projects into the chamber 112 to guide the separate powder flows so that they impinge and mix thoroughly before the flow of powder is deflected by the internal deflector 114.

The lower portion of the mixing chamber 112 is contained in mixing chamber housing 113, which is secured to inlet collar 111. From chamber 112 the flow of charged powder particles is deflected outwardly by the conical deflector 114, which is mounted to a housing 115, which is secured to the mixing chamber housing 113. Housing 115 includes a plurality of spray nozzles 117 disposed in a circle about the common longitudinal axis of the spray head 108 and support shaft 110. A plurality of passages 116 connect the nozzles 117 with the mixing chamber 112.

Charged air-entrained powder particles which are discharged from the nozzles 117 are directed towards, and deflected by, a primary, external deflector 118 which is mounted to distributor 115. Primary deflector 118 rather than having a radiussed annular surface as in the deflectors 18 of FIGS. 2 and 3, has instead a conical deflector surface 120 effective to produce a hollow, cone-shaped powder spray pattern with its axis coaxial with the longitudinal axis 28 of the spray head 108. It will be appreciated that the conical angle of the powder spray pattern and, to an extent, the radial thickness of the conical spray pattern, are dependent on the shape of the deflector surface 120. For particularly large conic angle spray patterns, deflector surface 120 may be curved, or radiussed, somewhat similar to deflector surfaces 20 of the spray heads 8 of FIGS. 2 and 3.

FIG. 4*a* illustrates in greater detail the lower portion of the spray head shown in FIG. 4 and also incorporates an alternative primary deflector 118*a* having a radiussed annular deflector surface 120*a* somewhat similar to that of the deflectors 18 of FIGS. 2 and 3 but to form a hollow conical spray pattern in which the angle of the cone is large. Chamber housing 113 and housing 115 are connected by matching screw threads (not shown), and O ring seals 127 provide a seal between the various elements. Primary deflector 118*a* is releasably connected to the housing 115 by means of bolts 129 (only one is shown) so as to be easily changed for one having a different deflector surface 120, 120*a*, and is generally in the form of an annular collar.

The conical deflector 114, shown in greater detail in FIGS. 5*a* and 5*b*, includes features, additional to those of deflector 14 of FIGS. 2 and 3, adapted to discharge a secondary spray pattern in the shape of a cone, the conical spray pattern being substantially coaxial with the hollow spray pattern and the spray head 108. Conical deflector 114 comprises a frusto-conical deflector section 130 having a threaded throughbore 132 coaxial with the spray head 108. A conical deflector piece 134 is mounted to the narrow, leading end of frusto-conical section 130, and is partially received within throughbore 132. Conical deflector piece 134 has a conical deflecting surface configured so as to continue the conical surface of frusto-conical section 130. A number of holes 138 are provided about the curved surface of the conical deflector piece 134, each hole 138 leading to a bore 140 running to the distal end of the deflector piece 134. Also received within the threaded portion of throughbore 132 is conduit 136, which has a matching thread 132*a* and a throughbore 142. When conduit 136 and deflector piece 134 are received within throughbore 132, throughbore 142 communicates with bore 140. As can be seen from FIG. 4*a*, conduit 136 has a stepped outer profile which, when conduit 136 is threadably secured to deflector section 130, abuts against the lower surface of the housing 115 and thereby locates and secures these elements in position relative thereto. An end cap 144 is mounted to the distal end of conduit 136 and has an axial stepped bore 146,150 extending therethrough. Around the distal section 150 of the stepped bore are a number of nozzles 148 disposed about a circle coaxial with the longitudinal axis 28 and communicating with the leading section 146 of the stepped bore. The leading section 146 of the stepped bore is mounted to the distal end of conduit 136 and the distal section 150 of the stepped bore is adapted to receive the leading end portion 156 of a secondary external deflector 152.

The secondary deflector 152 has a cylindrical leading end portion 156 and a curved or conical leading end 154; leading end portion 156 is adapted to fit within the distal section 150 of the stepped bore of end cap 144 so that the bearing surface 158 of the deflector 152 abuts end cap 144. The secondary deflector 152 has an annular radiussed deflector surface 160 pierced by a number of nozzles 162 extending substantially axially or at a small outwardly flared angle thereto and disposed about one or more circles coaxial with the common longitudinal axis 28 of the spray head 108. At the distal end of secondary deflector 152 is a tertiary external deflector 164 adapted and configured so as to deflect powder discharged from at least some of the nozzles 162 outwardly from the longitudinal axis 28.

In operation, the internal deflector 114 shown in FIGS. 4, 5*a* and 5*b* is effective to deflect the flow of charged powder passing through chamber 112 outwardly towards nozzles 117, in the same manner as that of deflector 14 of FIGS. 2 and 3. The deflector surface 120 is then effective to deflect powder discharged from nozzles 117 to create a hollow conical spray pattern coaxial with the longitudinal axis 28 of the spray head 108. The holes 138 in the surface of the conical deflector piece 134 are effective to divert at least a portion of the powder flow from the chamber 112 into bore 140 and thence into throughbore 142 of conduit 136. Approaching the distal end of throughbore 142 the powder flow is deflected outwardly by leading end 154 of secondary deflector 152 and evenly distributed between nozzles 148. The charged powder is discharged from nozzles 148 towards the curved surface 160 of secondary deflector 152. At least a portion of the powder discharged from nozzles 148 is diverted by nozzles 148, to be discharged from the distal ends thereof, and the remaining powder discharged from nozzles 148 is deflected outwardly by the secondary deflector surface 160. At least a portion of the powder discharged from nozzles 148 impacts on tertiary deflector 164 and deflected outwardly thereby at an angle to the longitudinal axis 28 of the spray head (which angle is normally less than that by which powder is deflected by curved surface 160). Powder discharged from nozzles 148 is deflected and diverted, by the secondary and tertiary deflectors 160,164 and nozzles 162 so as to form a substantially conical spray pattern centered on the longitudinal axis 28.

Depending on the configuration of the secondary and tertiary deflectors 160,164, and of the nozzles 162, the conical spray pattern produced by the secondary and tertiary deflectors extends from the longitudinal axis to the hollow conical spray pattern created by the primary deflector 118 so as to create a uniform conical spray pattern; alternatively, if required, the conical spray can be limited to a more restricted conic angle. This conic angle can be varied by changing the secondary deflector 152 for one with a different secondary deflector surface 160, or one with a different number or configuration of nozzles 162, or one with a different tertiary deflector 164.

To enable the conical spray pattern to be adjusted rapidly, secondary deflector 152 is releasably secured to end cap 144, such as by a press fit between distal end cap section 150 and leading end portion 156. Similarly, deflector 134 and conduit 136 are releasably mounted in frusto-conical deflector section 130 (deflector section 134 by a press fit, for example, and conduit 134 by means of screw thread 132*a* as described above) so that an end cap 134 with a different number or size of holes 138 may be used (to vary the amount of powder diverted from chamber 112) or to introduce a conduit 136 having a throughbore 142 of different diameter (to control the flow of powder therethrough). The end cap 144 is also releasably attached to the distal end of conduit 136, so as to be easily removed and replaced with one having a different number, size or configuration of nozzles 148 to control the speed, direction or distribution of the powder discharged therefrom. In the illustrated embodiment, all components of coating device 2', including deflector 134, conduit 136, end cap 144, and deflector 152 are formed of high density polyethylene; they could be formed of or coated with any suitably insulative material, such as polytetrafluoroethylene or similar material.

In order to remove and replace any of deflector section 130, end cap 134, or conduit 136, it is necessary to remove housing 115 from chamber housing 113. End cap 144 and deflector 152 may be easily detached and replaced without requiring any other parts of the spray head 108 to be disassembled.

Spray head 108 is also provided with an axially slidable collar 170 (see FIGS. 4 and 4*a*) which defines an annular channel between its leading edge 172 and the deflector surface 120 of primary deflector 118. Sliding of the collar 170 varies the width of this annular channel, through which powder discharged from nozzles 117 must flow. Therefore the collar 170 can be used to control the speed and, to an extent, given the configuration of the deflector surface 120 adjacent the leading edge 172 of the collar, the direction and/or the width of the hollow conical spray pattern. The leading edge 172 of collar 170 can be made asymmetric about and/or along the longitudinal axis (not shown) so that the speed of the powder flow varies around the circumference of the annular channel so as to effect an asymmetric distribution of powder in the hollow conical spray pattern, and/or to enable powder in some parts of the hollow conical spray pattern to travel faster, in order to coat a surface which is not aligned wholly perpendicularly to the longitudinal axis 28, for example.

Air assist means comprising an air inlet 121, communicating with an inlet passage 123 and thence to an annular outlet passage 125 formed in the sleeve 170 (see FIG. 4*a*) is provided to supply pressurized air into the annular channel between the leading edge 172 and deflector surface 120, 120*a* to improve the control of the powder discharged in the hollow conical spray pattern.

An internal flow restrictor 176 is provided, in the chamber 112 of the spray head 108. The inner surface of this flow restrictor 176 is configured to control the flow rate and distribution of the flow of powder within the chamber 112. The inner surface of the flow restrictor 176 may be eccentric (not shown) along the longitudinal axis 28, so as to create a biased distribution of powder emitted in the hollow conical and/or conical spray patterns. The flow restrictor 176 is releasably held, by O rings 127, within the chamber 112 so that it may easily be changed for one of a different configuration.

As will be immediately apparent, the slidable collar 170 and/or the internal flow restrictor 176 described above may be used to equivalent effect with the spray heads 8 shown in FIGS. 2 and 3.

Electrostatically charged powder is supplied to the spray head by charging device(s) which are preferably of the type described in British Patent Application No. 2066703 or U.S. Pat. No. 5,344,082, in which powder particles flowing therethrough are electrostatically charged by multiple frictional contact with the walls of the device.

The charging device(s) may be statically mounted and connected to the spray device 2' by flexible hoses 106 so that the spray device 2' may be reciprocated so as to vary the thickness of coating produced on the object by the conical spray pattern. Alternatively, the charging device(s) may be mounted so as to reciprocate with the spray device 2'.

In either case, the spray pattern produced by the spray device produces a coating of powder of substantially uniform thickness where the spray pattern impinges upon the surface of the object(s) to be coated. In order to coat a very large area it is necessary to provide relative movement between the spray pattern and the object, so that the powder spray pattern moves over and coats the surface of the object. This is conveniently achieved by moving the spray device 2', with or without the charging device(s), by manipulating the support shaft 110 with a mechanical device (not shown) such as a gun mover or robot arm, for example. Alternatively, the objects may be transported in a plane perpendicular to the longitudinal axis 28 of the device.

At the same time as powder is discharged in the hollow conical spray pattern, powder is also discharged in a conical spray pattern substantially coaxially with, and within, the hollow conical spray pattern. Thus the spray device 2' in accordance with the invention may be used uniformly to spray coat rapidly the entire surface of objects having a large surface area aligned perpendicularly to the longitudinal axis 28.

FIG. 6 illustrates schematically the apparatus of FIG. 4 mounted so as to reciprocate in the direction of the arrows in order to vary the area of the spray pattern produced on an object 26, so as to vary the thickness of powder coating deposited thereon. Two charging devices 4 are mounted by brackets 30 to the support shaft 110 which is reciprocated by a motor 32, so that the spray head 108 and the charging devices 4 moves closer to, or further away from, the object 26 to be coated.

The reciprocating motor 32 is suitably mounted to a bracket 34 which may be mounted to the wall of the powder spray booth (not shown), and flexible conduits and cables (not shown) are provided to supply the charging devices 4 with high pressure air, powder and electrical ground lines. Means are also provided (not shown) to ground the object 26 so that the electrostatically charged powder emitted from the spray head 108 is attracted, and adheres, thereto.

FIG. 7*a* shows an inlet distributor 33 for deflecting a single flow of air-entrained powder into a number of separate streams, each of which may then be directed through a separate charging device, as illustrated in FIG. 6. The inlet distributor 33 comprises several modules 331, 332, 333, 334 (shown in FIG. 7*b*). Air-entrained powder is supplied to the inlet 35 of the distributor 33 by a suitable pump (not shown) and along an internal flow passage 36. At the downstream end of the passage 36 is a deflector 38, which deflects the flow to a number of outlets 40, each of which is connected to a charging device 4.

To accelerate the flow of air-entrained powder, pressurized air is introduced to the inlet distributor 33 through an air inlet 42. Referring now to FIG. 7*b*, air inlet 42 is located on module 332 and air from the inlet 42 enters the passage 36 along a converging annular passage formed between tapering inner and outer surfaces 46, 44 which are provided on modules 332 and 331 respectively. Air emerging from this converging annular passage enters passage 36, which continues through each module, and accelerates the powder flow. The modules are connected together and an air-tight seal is provided between the modules by means of O rings 48.

FIG. 8 shows an apparatus in accordance with the invention, incorporating six tribo-electric charging devices (only one is shown, for clarity) and incorporating an inlet distributor 33. Although six charging devices 4 are used with the system illustrated in FIG. 8, there could be fewer or more, depending on the desired powder throughput of the spray device and the capacity of each charging device in which case the appropriate number of outlets 40 are provided and are preferably disposed equally around the longitudinal axis so that the flows through the charging devices 4 are substantially the same.

As diagrammatically illustrated in FIG. 8, a powder hose 50 preferably supplies powder coating material from a single pump 52 connected to a common powder supply 54 and controlled by controls 56. The powder flow supplied by pump 52 through hose 50 is divided by inlet distributor 33 into the six outlets 40.

The powder then passes from outlets 40 through the hoses 58 attached to each outlet 40 and from each hose 58 into the charging device 4 connected to each hose 58. A diffuser 60 is preferably located between each hose 58 and the associated charging device 4. Diffuser 60 is shown in greater detail in U.S. Pat. No. 4,401,275.

Each diffuser 60 includes a compressed air inlet 62. Compressed air introduced through inlet 62 passes through a porous sleeve 64 before intermixing with the air-powder mixture from hose 62 which is passing through the centre of diffuser 60 before entering charging device 4. The function of diffuser 60 is to ensure the uniform distribution of the flow of air-entrained powder entering the inlet of the charging device and further to promote the uniform distribution of powder within that flow. By accelerating the flow, the diffuser 60 also acts to break up any powder agglomerates and to prevent the accumulation of powder on the inner surfaces of the charging device 4.

The powder is charged in device 4 as previously described and then passes through the hose 106 associated with each device 4, and then from each of the hoses 106 into the common spray head 108 where the six individual powder flows are recombined and sprayed from spray head 108 in a single, large spray pattern including a hollow conical spray pattern component and a conical spray pattern component such as for coating an object of large surface area aligned perpendicularly to the longitudinal axis 28 of the device.

Thus, a single pump 52 having one set of controls 56 can be used to discharge a high flow rate of electrostatically charged powder through a single spray device in accordance with the teachings of this invention. This reduces the amount of investment and degree of complexity which would be required if a dedicated pump and set of controls were required for each charging device 4.

To enable rapid powder changes, for example, to change powder colour, a modified powder supply system may be provided as shown in FIGS. 9 and 10. In the powder supply system of FIGS. 9 and 10, three powder supplies: 54A, 54B, 54C, (only supply 54A is shown) each containing powder of a different colour, are provided. In what follows, the supply of one powder, colour A, is described, it being understood that the supply of powder colors B and C is substantially identical and elements identified by the subscript A have equivalents for supplying the other powders.

Powder is supplied from source 54A by pump 52A, via hose 50A to a dedicated inlet distributor 33A. A valve 68A, such as an air operated pinch valve, is located in the powder supply line between the pump 52A and inlet distributor 33A, and the valve 68A is actuated and the pump 52A is controlled by a controller 70 (which also actuates valves 68B, 68C and controls pumps 52B, 52C)

Powder flowing through inlet distributor 33A is entrained by pressurized air entering inlet 42A and distributed between hoses 58A. Powder flows through hoses 58A to diffusers 60A each of which, using pressurized air introduced via hoses 62A, accelerates the flow of powder into an associated charging device 4. It will be appreciated that, although FIGS. 9 and 10 illustrate a three colour powder system in which each powder is charged by two charging devices 4, the system can be adapted to provide any number of powder sources and associated charging devices.

The powder supply system of FIGS. 9 and 10 is operated to change the powder sprayed from colour A to colour B as follows.

Whilst spraying colour A, powder pump 52A pumps powder to inlet distributor 33A and valve 68A is open. Air is supplied through inlet 42A and air-entrained powder passes through hoses 58A to diffusers 60A. Pressurized air is supplied via hoses 62A to diffusers 60A to accelerate the powder flow into the associated charging devices 4. The controller 70 ensures that pumps 52B, 52C are inactive and valves 68B, 68C closed. A small amount of pressurized air is supplied to inlets 42B, 42C (so as to prevent contamination of any part of the system for supplying and charging powder from sources 54B and 54C with powder from source 54A) but no air is supplied to hoses 62B, 62C and diffusers 60B, 60C are inactive.

To change to powder B, firstly the controller 70 closes all pumps 52A–C and all valves 68A–C. Pressurized air is preferably then fed to all inlets 42A–C and all hoses 62A–C to clean out the powder paths; this air may be pulsed in order thoroughly to purge the system. It might also be necessary to clean the outer parts of the spray head (108, not shown), and/or to disassemble the spray head for annual cleaning, before commencing spraying with the next powder.

Once the system has been cleaned, the controller 70 activates pump 52B and opens valve 68B. Pressurized air is supplied through inlets 42B and hoses 62B, so that powder B is supplied to the respective charging devices 4. Air is also provided at lower pressure to inlets 42A, 42C and hoses 62A, 62C but pumps 52A, 52C remain inactive and valves 68A, 68C remain closed therefore no powder is supplied to inlet distributors 33A, 33C and the associated charging devices.

The system shown in FIGS. 9 and 10 enables a rapid and wholly automatic powder colour change to be made (with the possible exception of the cleaning of the spray device).

FIG. 11 illustrates an alternative form of conical guide 122*a* which is provided with an obstructing device, or obturator, 180 for selectively opening and closing the powder supply conduits 106 leading to the respective powder sources 54A,B,C so as to prevent contamination of a path for supplying powder from a source by powder from another source which is being sprayed.

Conical guide 122*a* may be used additionally with, or alternatively to, providing air at lower pressure to the respective inlets 42A–C and hoses 62A–C in order to prevent contamination.

Obstructing device or Obturator 180 is shown in the form of an angled flange (although it is not necessary that the flange be angled, it could equally be in the form of a disc) and has a number of holes 182 disposed around its circumference. Conical guide 122*a* is rotated about axis 28 (by means not shown) so as to bring holes 182 into alignment with those supply conduits 106 through which a particular powder is to pass to be sprayed. The rotating means is suitably a pneumatically operated actuator located within, and substantially coaxially with, support shaft 110, which is formed with a hollow chamber at its lower end and air inlet and outlet passages (not shown) for this purpose. Simultaneously, those supply conduits 106 leading to the other powder sources are closed off by the solid portion of obturator 180. Conical guide 122*a* is rotatably housed within inlet collar 111*a* and chamber housing 113*a*, and suitable sealing means (not shown) may be provided, such as O ring seals, provided therebetween to improve the seal effected by the obturator 180. It will be appreciated that the features shown in FIGS. 9, 10 and 11 are equally applicable for use with each of the powder spray devices shown in FIGS. 2 to 4 when multiple powder sources are used.

Methods and apparatus for powder spray coating in accordance with the invention enable the rapid coating of large surface areas with a uniform coating of powder with a minimum of powder loss through rebounding or deflection. In addition, the use of low-voltage frictional devices to electrostatically charge the air-entrained powder provides improved safety by reducing the spark hazard arising with a conventional high-voltage powder charging device utilizing external electrodes in an enclosed space such an as oil drum filled with combustible powder. The use of an inlet distributor to distribute the flow of air-entrained powder evenly through several charging devices enables the powder to be supplied by a single pump, rather than the more costly alternative of providing a separate pump and associated control means for each charging device as previously mentioned. In other aspects of the invention, increased control of the distribution of the discharged powder is provided, rapid and automatic powder colour changes are facilitated, and contamination of the powder supply paths for supplying powder from one source by powder from another source is prevented.

It will be readily appreciated by those skilled in the art that various modifications to the features described herein are possible, and that the separate features described herein may be utilized individually or in combination. For example, the spray head 108 illustrated in FIG. 4 may be provided with a curved primary deflector 18 such as that shown in FIGS. 2 and 3 in order to provide a spray pattern comprising a flat, disc-shaped component and a conical component; such an arrangement could be utilized to coat rapidly the internal curved and flat end surfaces of a drum having one open end by lancing the device into and out of the drum.

I claim:

1. An apparatus for powder spray coating comprising means for electrostatically charging powder entrained in air and means for transporting the flow of electrostatically charged powder from the charging means to a spray head, wherein the spray head comprises means for diverting at least a portion of the flow of charged powder towards a spray device mounted to the spray head and adapted to discharge powder in a conical spray pattern, and wherein the spray head is adapted to discharge the remaining powder in a hollow conical spray pattern, the spray head, spray device and the hollow conical and conical spray patterns being substantially symmetrical about a common longitudinal axis.

2. An apparatus as claimed in claim 1 wherein the spray head comprises an internal chamber to which the charged powder is supplied having at least one passage from the internal chamber to at least one nozzle from which the powder is discharged and a primary deflector mounted externally of the spray head and adjacent to the or each nozzle to deflect the discharged powder into the hollow conical spray pattern, the or each nozzle being directed outwardly from the longitudinal axis, the internal chamber containing an internal deflector to deflect the flow of air-entrained electrostatically charged powder outwardly toward the or each nozzle.

3. Apparatus as claimed in claim 2 wherein the diverting means comprises one or more holes in the surface of the internal deflector through which is diverted said portion of the flow of charged powder to channel means for conducting the diverted powder to the spray device.

4. Apparatus as claimed in claim 3 wherein the channel means comprises a conduit for transporting the diverted powder from the holes in the internal deflector to an internal chamber in the spray device, the spray device comprising at least one passage from the internal chamber to at least one nozzle from which the powder is discharged and a secondary deflector mounted externally of the spray device and adjacent to the or each said nozzle to deflect and direct the flow of discharged powder into a conical spray pattern.

5. Apparatus as claimed in claim 4 wherein the secondary deflector is adapted to deflect and direct the discharged powder into a conical spray pattern subtending substantially the entire conic angle between the longitudinal axis and the hollow conical spray pattern.

6. Apparatus as claimed in claim 4 wherein the spray device comprises two or more nozzles disposed about the circumference of a circle centered on the longitudinal axis.

7. Apparatus as claimed in claim 4 wherein the secondary deflector has a curved deflector surface to deflect the discharged powder impacting thereon radially outwardly at an angle to the longitudinal axis, there being at least two holes in the deflector surface leading to nozzle passages for directing at least a portion of the flow of powder in a tertiary conical spray pattern.

8. Apparatus as claimed in claim 7 wherein the holes in the secondary deflector are disposed about the circumference of one or more circles centered on the longitudinal axis so as to form one or more annular arrays.

9. Apparatus as claimed in claim 7 wherein the nozzle passages are substantially parallel to the longitudinal axis.

10. Apparatus as claimed in claim 7 comprising a tertiary deflector mounted externally of the spray device and disposed so as to deflect the powder discharged from at least one of the nozzle passages radially outwardly at an angle to the longitudinal axis.

11. Apparatus as claimed in claim 1 wherein the diverting means is removably mounted within the spray head.

12. Apparatus as claimed in claim 1 wherein the spray device is removably mounted to the spray head.

13. The apparatus of claim 2 further comprising a collar around the spray head and having a leading edge forming an annular discharge channel adjacent the nozzle(s) and the primary deflector and mounted so as to be slidably movable along the longitudinal axis in order to adjust the size of the annular discharge channel, thereby to control the flow of powder in the hollow conical spray pattern.

14. The apparatus of claim 13 wherein the collar comprises means for introducing a flow of pressurized air into the annular discharge channel to control the speed of the powder discharged in the flat spray pattern.

15. The apparatus of claim 13 wherein the leading edge of the collar is asymmetrically configured along and/or about the longitudinal axis, thereby to produce a hollow conical powder spray pattern in which the hollow conical pattern has a varying thickness, and/or in certain sectors of which the powder particles move with different speeds as compared with powder particles in other sectors thereof.

16. The apparatus of claim 2 wherein the internal chamber releasably contains an annular flow restrictor to control the flow of charged powder within the chamber.

17. The apparatus of claim 16 wherein the flow restrictor is asymmetrical about the longitudinal axis, thereby to create an asymmetric distribution of powder discharged in the hollow conical spray pattern.

18. An apparatus for powder spray coating comprising means for electrostatically charging powder entrained in air, a conduit for transporting the electrostatically charged powder from the charging means to an internal chamber in a spray head, the spray head having at least one passage from the internal chamber to at least one nozzle from which the powder is discharged, and a primary deflector mounted externally of the spray head and adjacent to the or each nozzle and adapted to deflect the discharged powder into a spray pattern, the spray head and the deflector being substantially symmetrical about a common longitudinal axis, wherein a collar is provided around the spray head to form, an annular discharge channel adjacent the nozzle(s) and the primary deflector and mounted so as to be slidably movable along the longitudinal axis in order to adjust the size of the discharge channel.

19. The apparatus of claim 18 wherein means are provided for introducing a flow of pressurized air into the discharge channel, thereby to control the flow of powder discharged through the discharge channel.

20. An apparatus for powder spray coating comprising means for electrostatically charging powder entrained in air, a conduit for transporting the electrostatically charged powder from the charging means to an internal chamber in a spray head, the spray head having at least one passage from the internal chamber to at least one nozzle from which the powder is discharged, and a primary deflector mounted externally of the spray head and adjacent to the or each nozzle and adapted to deflect the discharged powder into a spray pattern, wherein the internal chamber contains a flow restrictor thereby to control the flow of charged powder within the chamber, and wherein said restrictor is releasably held within said chamber.

21. The apparatus of claim 20 wherein the annular flow restrictor is asymmetrical about the longitudinal axis, to create an asymmetric distribution of powder discharged.

22. The apparatus of claim 1 comprising two or more charging means to apply the electrostatic charge to the powder, each charging means having a separate conduit to an internal chamber of the spray head, wherein means are provided within the chamber to guide the separate flows of powder so that they impinge and mix before the combined flow is discharged from the spray head or diverted towards the spray device.

23. The apparatus of claim 1 comprising at least two means for electrostatically charging powder wherein the powder is supplied by a pump from a source to an inlet distributor comprising a powder flow passage and a deflector within the powder flow passage to deflect the flow of air-entrained powder into a number of streams, each stream being directed towards a particular charging means.

24. An apparatus for powder spray coating comprising at least two conduits for transporting electrostatically charged powder from at least two charging devices to an internal chamber in a spray head, the spray head having at least one passage from the internal chamber to at least one nozzle from which the powder is discharged, the apparatus further comprising at least two pumps, each pump being arranged to supply powder coating material from a related powder source to at least one charging device, and control means adapted selectively to control the pumps to discharge powder from a particular source through the spray head.

25. The apparatus of claim 23 further comprising a plurality of pumps, each pump being arranged to supply powder coating material from an associated powder source to a related inlet distributor, each inlet distributor being arranged to distribute a flow of powder to one or more charging means, and control means adapted selectively to control the pumps to discharge powder from a particular source from the spray head and the spray device.

26. The apparatus of claim 25 further comprising a valve in the powder supply line extending between each powder pump and the associated inlet distributor, wherein the control means is adapted selectively to actuate one of the pumps and to open the valve associated therewith.

27. The apparatus of claim 26 wherein the control means is adapted to deactivate said pumps, to close the valve(s) associated therewith and to introduce air into the powder flow passage(s) related therewith at a pressure lower than that of the air introduced into the other said powder flow passage.

28. Apparatus as claimed in claim 25 comprising obstructing means selectively operable so as to seal one or more of the powder flow passages extending between the spray head and the powder sources upstream of the spray head.

29. The apparatus of claim 2 wherein the primary deflector mounted externally of the spray head is movable along the longitudinal axis relative to the spray head.

30. The apparatus of claim 1 further comprising frictional, or tribo-electrical, charging means to apply the electrostatic charge to the powder.

31. The apparatus of claim 1 comprising means to produce relative motion, along the longitudinal axis, between the hollow conical spray patterns and the object(s) to be coated thereby.

32. Apparatus as claimed in claim 31 wherein the means to produce relative motion comprises means to reciprocate the spray head.

33. Apparatus as claimed in claim 2 wherein the primary deflector has a conical powder deflecting surface.

34. A method for powder spray coating comprising supplying air-entrained electrostatically charged powder to a spray head, diverting at least a portion of the powder to a spray device mounted to the spray head and adapted to discharge powder in a conical spray pattern, discharging the remaining portion of the powder from at least one nozzle and deflecting said discharged powder into a hollow conical spray pattern, the hollow conical spray pattern and the conical spray pattern being substantially symmetrical about the longitudinal axis of the spray head.

35. A method of powder spray coating comprising supplying air-entrained electrostatically charged powder to a spray head, discharging the powder from at least one nozzle, deflecting the discharged power into either a flat or a hollow conical spray pattern, and adjusting the size of an annular discharge channel through which the discharged powder flows to control the flow of powder through the discharge channel.

36. A method as claimed in claim 35 further comprising introducing pressurized air into the annular discharge channel.

37. A method of powder spray coating, comprising the steps of transporting air-entrained electrostatically charged powder to a spray head, discharging the powder from at least one nozzle of the spray head and deflecting the discharged powder into either a flat or a hollow conical spray pattern, wherein the step of supplying the charged powder comprises supplying the powder through a flow restrictor to thereby accelerate the flow of powder, wherein said flow restrictor is releasable from said chamber.

38. A method as claimed in claim 37 wherein the step of supplying the charged powder comprises supplying a flow of powder which is not uniformly distributed about the longitudinal axis, thereby to create an asymmetric distribution of powder discharged in the spray pattern.

39. A method of powder spray coating comprising the steps of:

(a) providing two or more sources of different powder coating materials;

(b) providing a pump for each source to transfer powder coating material from the source to one or more charging devices for electrostatically charging the powder;

(c) transporting the powder from said charging devices to a common internal chamber of a spray head;

(d) transporting the powder from the chamber to a nozzle associated with the spray head; and (e) selectively controlling the pumps to selectively supply the powder coating material from one of the sources through the associated charging device(s) to the internal chamber for discharge through the nozzle as a spray pattern.

40. A method as claimed in claim 32 comprising reciprocating the spray head so as to vary the thickness of powder deposited on the object(s) to be coated with powder.

41. The method of claim 32 wherein the air-entrained powder is charged electrostatically by more than one charging device, the method comprising pumping air-entrained powder from a powder source using a single pump and dividing the flow of powder evenly into a number of separate streams, each stream being directed into a separate charging device.

42. A method as claimed in claim 41 comprising selectively operating one of a plurality of pumps, each effective to pump air-entrained powder from a related powder source to a related means effective to divide the flow of powder evenly into a number of separate streams, each stream being directed into a separate charging device, thereby selectively to spray powder from a particular source.

43. The method of claim 41 further comprising ceasing pumping powder from the powder source and introducing pressurized air into the dividing means to purge the powder flow paths.

44. An apparatus for powder spray coating electrostatically charged powder entrained in air comprising: a conduit for transporting the electrostatically charged powder from the charging means to an internal chamber in a spray head, the spray head having at least one passage from the internal chamber to at least one nozzle from which the powder is discharged, and a primary deflector mounted externally of the spray head and adjacent to the or each nozzle and adapted to deflect the discharged powder into a spray pattern, wherein a collar is provided around the spray head to form an annular discharge channel adjacent the nozzle(s) and the primary deflector.

45. The assembly of claim 44 wherein said collar is slidably mounted so as to be slidably movable in order to adjust the width of the discharge channel.

46. The apparatus of claim 45 wherein a leading edge of said collar is asymmetrically located about the longitudinal axis of the spray head.

47. A spray head for powder spray coating electrostatically charged particles comprising; an internal chamber to which the charged powder is supplied having at least one internal passageway from the internal chamber to at least one nozzle from which the powder is discharged, and a primary deflector mounted to said spray head and adjacent to the or each nozzle to deflect the discharged powder into a hollow conical spray pattern.

48. The spray head of claim 47 further comprising means for diverting a portion of the powder flow from the chamber to a secondary deflector having a curved deflector surface to deflect the discharged powder impacting thereon radially outward.

49. The spray head of claim 47 further comprising a tertiary deflector and disposed so as to deflect the powder at an angle to the longitudinal axis of the spray head.

* * * * *